US008783816B2

(12) United States Patent
Masuda

(10) Patent No.: US 8,783,816 B2
(45) Date of Patent: Jul. 22, 2014

(54) PRINTING APPARATUS

(75) Inventor: Kazunori Masuda, Asaka (JP)

(73) Assignee: Canon Kabushiki Kaisha, Tokyo (JP)

( * ) Notice: Subject to any disclaimer, the term of this patent is extended or adjusted under 35 U.S.C. 154(b) by 316 days.

(21) Appl. No.: 13/174,196

(22) Filed: Jun. 30, 2011

(65) Prior Publication Data

US 2012/0007908 A1 Jan. 12, 2012

(30) Foreign Application Priority Data

Jul. 7, 2010 (JP) ..... 2010-155251

(51) Int. Cl.
*B41J 29/38* (2006.01)

(52) U.S. Cl.
USPC ..... 347/17; 347/5; 347/14

(58) Field of Classification Search
USPC ..... 347/5, 9, 14, 17, 19
See application file for complete search history.

(56) References Cited

U.S. PATENT DOCUMENTS

| | | | | |
|---|---|---|---|---|
| 5,696,543 | A * | 12/1997 | Koizumi et al. | 347/17 |
| 5,764,246 | A * | 6/1998 | Wataya et al. | 347/14 |
| 7,802,866 | B2 | 9/2010 | Kanno et al. | |
| 2002/0135037 | A1 | 9/2002 | Tomomatsu | 257/467 |
| 2005/0104919 | A1 * | 5/2005 | Takayanagi | 347/17 |
| 2005/0110813 | A1 * | 5/2005 | Masuda | 347/5 |
| 2007/0057984 | A1 | 3/2007 | Takamiya et al. | 347/10 |
| 2008/0043063 | A1 | 2/2008 | Bergstedt et al. | |

FOREIGN PATENT DOCUMENTS

| | | | |
|---|---|---|---|
| CN | 101092075 | A | 12/2007 |
| EP | 0876915 | A | 11/1998 |
| JP | 07-323572 | A | 12/1995 |
| JP | 8-136356 | | 5/1996 |
| JP | 2001-162785 | A | 6/2001 |
| JP | 2002-280556 | | 9/2002 |
| JP | 3450602 | A | 9/2003 |
| JP | 3509623 | | 3/2004 |
| JP | 2005-147895 | | 6/2005 |
| JP | 2007-069575 | | 3/2007 |
| JP | 2007-181983 | A | 7/2007 |

OTHER PUBLICATIONS

Chinese Office Action dated Oct. 22, 2013 in Chinese Appl. No. 201110192816.5.

* cited by examiner

*Primary Examiner* — Lam S Nguyen
(74) *Attorney, Agent, or Firm* — Fitzpatrick, Cella, Harper & Scinto

(57) ABSTRACT

A printing apparatus includes a printhead incorporating a temperature sensor, a control unit which controls the printhead, and a flexible cable which connects the printhead and the control unit. The flexible cable includes a first signal line and second signal line which generate voltages corresponding to the temperature of the printhead, and are connected to the temperature sensor. A differential amplifier circuit which is incorporated in the control unit amplifies the voltage difference between the first signal line and the second signal line to output the amplified voltage difference as temperature information of the printhead. A matching circuit makes the wiring resistances of the first signal line and second signal line match each other by grounding either the first signal line or the second signal line via a resistor in the printhead.

11 Claims, 15 Drawing Sheets

MOS PROCESS
<SUBSTRATE PNP TRANSISTOR>

MOS PROCESS
<SUBSTRATE NPN TRANSISTOR>

BIPOLAR PROCESS
<NPN TRANSISTOR>

BIPOLAR PROCESS
<SUBSTRATE PNP TRANSISTOR>

BIPOLAR PROCESS
<LATERAL PNP TRANSISTOR>

BIPOLAR PROCESS
<VERTICAL PNP TRANSISTOR>

FIG. 17

* CALCULATION CONDITIONS : Ibias = 0.2mA, rbb = 50Ω, $R_X$ = 13kΩ

| | $R_{BC}$ 10Ω | | $R_{BC}$ 50Ω | | $R_{BC}$ 100Ω | | $R_{BC}$ 150Ω | | $R_{BC}$ 500Ω | | $R_{BC}$ 1000Ω | | $R_{BC}$ 5000Ω | |
|---|---|---|---|---|---|---|---|---|---|---|---|---|---|---|
| hfe | $R_A$ | $R_K$ | $R_A$ | $R_K$ | $R_A$ | $R_K$ | $R_A$ | $R_K$ | $R_A$ | $R_K$ | $R_A$ | $R_K$ | $R_A$ | $R_K$ |
| 200 | 129.6 | 10.0 | 129.8 | 50.0 | 130.0 | 100.0 | 130.3 | 150.0 | 132.0 | 499.9 | 134.5 | 999.6 | 154.5 | 4990.5 |
| 100 | 129.9 | 10.0 | 130.3 | 50.0 | 130.8 | 100.0 | 131.3 | 150.0 | 134.8 | 499.8 | 139.8 | 999.2 | 179.8 | 4981.0 |
| 50 | 130.5 | 10.0 | 131.3 | 50.0 | 132.3 | 100.0 | 133.3 | 150.0 | 140.3 | 499.6 | 150.3 | 998.5 | 230.3 | 4962.2 |
| 20 | 132.3 | 10.0 | 134.3 | 50.0 | 136.8 | 100.0 | 139.3 | 149.9 | 156.8 | 499.0 | 181.8 | 996.2 | 381.8 | 4906.6 |
| 10 | 135.3 | 10.0 | 139.3 | 50.0 | 144.3 | 99.9 | 149.3 | 149.8 | 184.3 | 498.1 | 234.3 | 992.4 | 634.3 | 4816.6 |
| 5 | 141.3 | 10.0 | 149.3 | 50.0 | 159.3 | 99.8 | 169.3 | 149.7 | 239.3 | 496.2 | 339.3 | 985.0 | 1139.3 | 4646.4 |
| 2 | 159.3 | 10.0 | 179.3 | 49.9 | 204.3 | 99.6 | 229.3 | 149.1 | 404.3 | 490.7 | 654.3 | 963.4 | 2654.3 | 4201.5 |
| 1 | 189.3 | 10.0 | 229.3 | 49.8 | 279.3 | 99.2 | 329.3 | 148.3 | 679.3 | 481.7 | 1179.3 | 929.5 | 5179.3 | 3624.8 |

PRINTING APPARATUS

BACKGROUND OF THE INVENTION

1. Field of the Invention

The present invention relates to a printing apparatus in which a printhead incorporates a temperature sensor.

2. Description of the Related Art

The printhead of inkjet printing apparatuses that are formed from a semiconductor integrated circuit are known to suffer an increase in ink discharge amount along with the temperature rise of the printhead. High reproducibility and color stability of printed images even during continuous printing is required from inkjet printing apparatuses. This has prompted development of a technique for precisely controlling the driving voltage and driving pulse of a printhead (Japanese Patent Laid-Open No. 2007-69575). According to this technique, the signal processing circuit of the printing apparatus adjusts the driving conditions (driving voltage and driving pulse) of the printhead based on temperature data detected by a temperature sensor incorporated in the printhead, and performs control in order to make the ink discharge amount uniform.

However, during a printing operation, high-frequency noise from a digital signal such as a print data signal is combined with an output signal from the temperature sensor incorporated in the printhead, and inhibits accurate temperature detection. Hence, the period during which the driving conditions (driving voltage and driving pulse) of the printhead can be controlled is limited to the interval between printing operations (periods when no ink is discharged at the sheet end or the like).

In general, a temperature detection arrangement such as the temperature sensor incorporated in the printhead often uses a diode temperature sensor arrangement which detects the forward voltage of a forward biased p-n junction. It is therefore necessary to detect a small voltage change complying with the temperature characteristic (−2 mV/° C.) of the forward voltage of the p-n junction. In the semiconductor integrated circuit which supports the temperature sensor, digital signals such as a data signal and clock signal are supplied next to the temperature detection signal line. Noise from these digital signals is combined with the temperature detection signal, resulting in error in detected temperatures.

Japanese Patent Laid-Open No. 8-136356 describes an arrangement which can reduce an offset generated in a detected voltage by restricting, to a predetermined current range, a DC bias current Ibias for forward biasing the p-n junction of a diode temperature sensor, and setting the operation resistance of the diode to a predetermined value. To set the operation resistance to a predetermined value, a resistor is series-connected to the diode. However, in a diode temperature sensor formed as a substrate transistor structure, the DC bias current flows through the substrate, and may raise the substrate potential to cause latch-up. To prevent this, the DC bias current needs to be minimized. Further, series-connecting the resistor to the diode is not desirable because the detection sensitivity for the forward voltage of the diode upon a temperature change decreases and thus the S/N ratio drops.

Japanese Patent Laid-Open No. 2005-147895 describes an arrangement in which resistors are interposed between the anode of a diode temperature sensor and the power supply and between the cathode and GND. This arrangement can reduce combined noise by equalizing resistance values. However, a diode temperature sensor formed from a forward biased p-n junction in a semiconductor integrated circuit has a transistor structure. Especially in a semiconductor integrated circuit using a normal CMOS process, a substrate transistor can form a forward biased p-n junction. For a p-type substrate, a special process needs to be introduced to form a diode temperature sensor floated from GND. Also, Japanese Patent Laid-Open No. 8-136356 does not particularly mention a concrete arrangement position of the resistor.

Japanese Patent Laid-Open No. 2002-280556 describes an arrangement in which capacitors are interposed between the cathode of a diode temperature sensor and the substrate of a semiconductor element and between the anode and the substrate, and the two capacitors have the same the capacitance value. However, the capacitance value of a capacitor formable in a semiconductor integrated circuit is as small as about several pF, and is not enough to reduce combined noise.

Japanese Patent No. 3509623 describes an arrangement in which an RC filter is formed in a semiconductor chip with respect to the read signal line of a semiconductor temperature sensor to remove noise. The resistor of the RC filter is series-connected to a temperature sensor element, and a capacitor is parallel-connected. The capacitor is formed on a gate oxide film on a contact pad. However, noise combined with a diode temperature sensor has a vertically asymmetrical voltage waveform due to nonlinearity of the diode. Despite smoothing by the RC filter, a DC component is generated as an offset voltage, resulting in a temperature detection error. In addition, series-connecting the resistor to the diode temperature sensor is not desirable because the temperature detection sensitivity drops.

SUMMARY OF THE INVENTION

An aspect of the present invention is to eliminate the above-mentioned problems with the conventional technology. The present invention provides a printing apparatus which effectively reduces a noise signal combined with a signal output from a temperature sensor.

The present invention in its first aspect provides a printing apparatus including a control unit which controls a printhead incorporating a temperature sensor, and a cable which connects the printhead and the control unit, comprising: a first signal line and a second signal line configured to be respectively laid out on the cable, generate voltages corresponding to a temperature of the printhead, and are connected to the temperature sensor; a differential amplifier circuit configured to be incorporated in the control unit, and amplifies a voltage difference between the first signal line and the second signal line to output the amplified voltage difference as temperature information of the printhead; and a matching circuit configured to make a wiring resistance of the first signal line and a wiring resistance of the second signal line match each other by grounding one of the first signal line and the second signal line via a resistor in the printhead.

The present invention in its second aspect provides a printing apparatus including a control unit which controls a printhead incorporating a temperature sensor, and a cable which connects the printhead and the control unit, comprising: a first signal line and a second signal line configured to be respectively laid out on the cable, generate voltages corresponding to a temperature of the printhead, and are connected to the temperature sensor; a differential amplifier circuit configured to be incorporated in the control unit, and amplifies a voltage difference between the first signal line and the second signal line to output the amplified voltage difference as temperature information of the printhead; and a circuit configured to connect a ground of the printhead to one of the first signal line and the second signal line via a resistor in the printhead so that a wiring resistance of the first signal line is equal to a wiring resistance of the second signal line.

The present invention can effectively reduce a noise signal combined with a signal output from a temperature sensor.

Further features of the present invention will become apparent from the following description of exemplary embodiments with reference to the attached drawings.

BRIEF DESCRIPTION OF THE DRAWINGS

FIG. 17 is a table showing the result of calculating input impedances $R_A$ and $R_K$ while changing the $R_{BC}$ value.

DESCRIPTION OF THE EMBODIMENTS

Figure 1A:
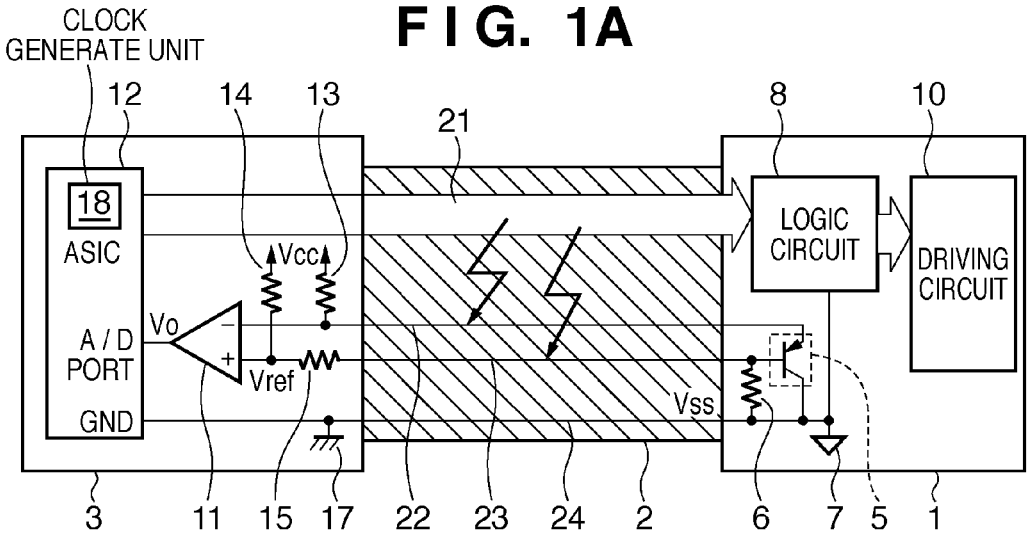
FIGS. 1A and 1B are diagrams each showing an arrangement including a printhead and control unit in an embodiment.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals denote the same parts, and a repetitive description thereof will be omitted.

FIG. 1A is a diagram showing an arrangement including a printhead and control unit in an embodiment of the present invention. The embodiment will exemplify a temperature sensor which detects the emitter-base voltage of a pnp transistor or npn transistor. A printhead 1 shown in FIG. 1A is that of an inkjet printing apparatus, and a control unit 3 controls driving of the printhead 1. A temperature sensor 5 has the structure of a pnp transistor or npn transistor. The temperature sensor 5 will now be explained as a pnp transistor in FIG. 1A. The temperature sensor 5 will now be explained as a npn transistor in FIG. 1B. A wiring member 2 connects the printhead 1 and control unit 3, and is formed from a flexible printed board (flexible cable) or the like serving as a signal transmission line. The control unit 3 includes a signal processing unit 12, and a differential amplifier circuit 11 which amplifies the voltage difference between signal lines 22 and 23 that is output from the temperature sensor. A signal processing unit 12 comprises a clock generate unit 18. The clock generate unit 18 generates a clock signal. In the printhead 1, a logic circuit 8 receives a plurality of digital signals such as image data and a head driving signal output from the signal processing unit 12 via signal line (wiring line) 21, and drives a driving circuit 10. Signal line 21 is line for clock signal and data signal. As a result, ink is discharged from nozzles determined based on the received data out of many ink discharge nozzles of the printhead 1.

Figure 11:
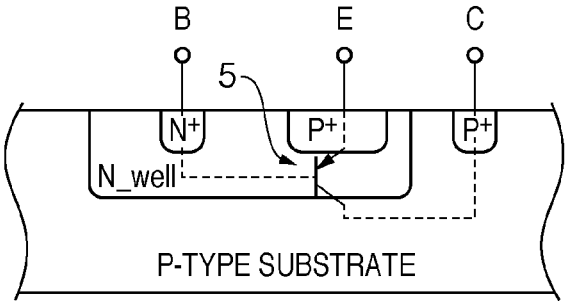
FIG. 11 is a sectional view showing the structure of a temperature sensor.

The printhead 1 is manufactured by a CMOS process, and the temperature sensor 5 is formed with a substrate pnp transistor structure as shown in FIG. 11. The first signal line 22 is connected to the emitter terminal of the temperature sensor 5, and the second signal line 23 is connected to the base terminal of the temperature sensor 5. The collector terminal of the temperature sensor 5 is connected to a minimum-potential GND wiring line (VSS wiring line 24) and grounded. The collector terminal of the transistor 5 is connected to a conductor 7. To supply a forward current (DC bias current) to the temperature sensor 5, a resistor 13 is interposed between the first signal line 22 and the power supply Vcc (for example, 3.3 V). The second signal line 23 is connected to the base terminal of the transistor 5 and the conductor 7 via a resistor 6. The second signal line 23 of the temperature sensor 5 is connected not to the GND pattern of the control unit 3 but to the reference voltage-side terminal V+ of the differential amplifier circuit 11 via a resistor 15. To determine a reference voltage at the reference voltage-side terminal of the differential amplifier circuit 11, the second signal line 23 is connected to the power supply Vcc via a resistor 14, and divides the Vcc voltage using the resistor 15 for the reference voltage. The differential amplifier circuit 11 amplifies the voltage difference between the first signal line 22 and the second signal line 23, and outputs the result as temperature information Vo of the printhead 1.

A difference from a conventional arrangement will now be explained with reference to FIG. 2. In the conventional arrangement, as shown in FIG. 2, the second signal line 23 runs from the printhead 1 independently of the VSS wiring line 24, and is connected to the GND pattern of the control unit 3 in order to suppress voltage fluctuation noise generated depending on the presence/absence and magnitude of a return current flowing through the VSS wiring line 24 from the logic circuit 8.

Figure 2:
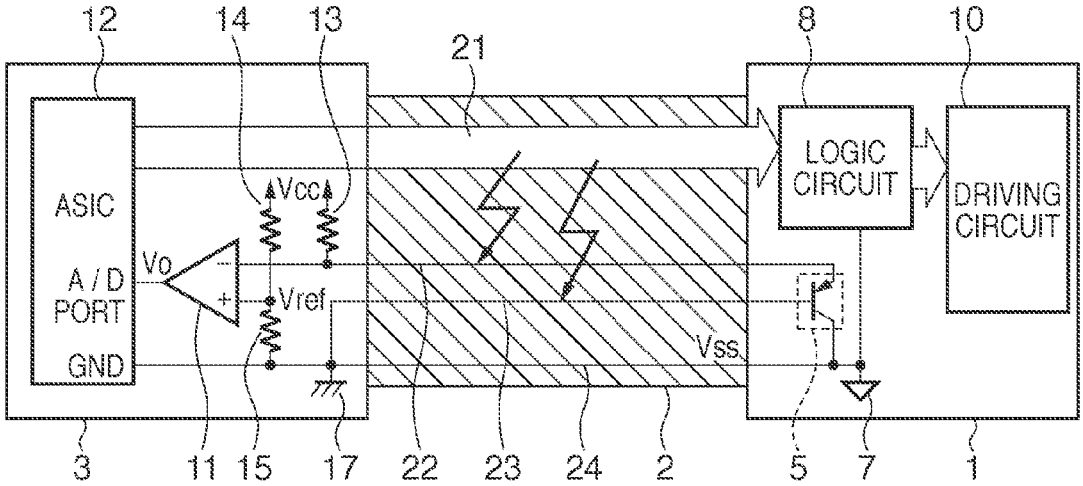
FIG. 2 is a diagram showing a conventional arrangement including a printhead and control unit.

As is apparent from a comparison between FIGS. 1A and 2, the arrangement of the embodiment is different from the conventional arrangement in the second signal line 23 and resistor 6. In the embodiment, the 0–V reference of a reference voltage Vref input to the +terminal of the differential amplifier circuit 11 is used as the internal GND of the printhead 1. Hence, the power supply voltage Vcc of the control unit 3 is divided by the three resistors 6, 14, and 15, as indicated by equation (1):

$$V\text{ref}=Vcc\times(R15+R6)/(R14+R15+R6) \quad (1)$$

In contrast, in the arrangement shown in FIG. 2, the 0–V reference of the reference voltage Vref input to the +terminal of the differential amplifier circuit 11 is used as GND 17 of the control unit 3.

As shown in FIG. 1A, the first signal line 22, second signal line 23, and GND wiring line (VSS) 24 running from the temperature sensor 5 are connected from the printhead 1 to the control unit 3 via the wiring member 2. On the wiring member 2 serving as a signal transmission line formed from a flexible printed circuit board (FPC board) or the like, a line for the digital signals such as a data signal and clock signal is laid out next to the first signal line 22 and second signal line 23. On the wiring member 2, noise from the signal line 21 is combined with the first signal line 22 and second signal line 23, generating an error in the temperature of the printhead 1 that is detected by the control unit 3.

Figure 10:
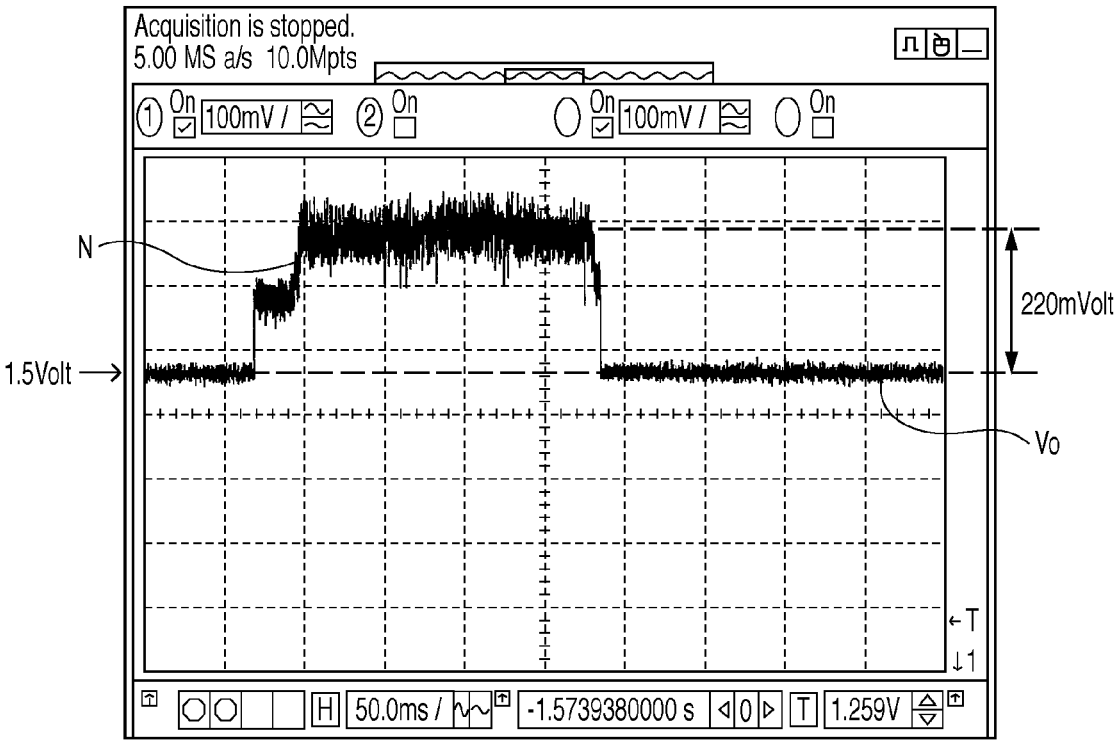
FIG. 10 is a view showing the result of actually measuring a detected temperature by the arrangement shown in FIG. 2.

FIG. 10 shows the measured voltage wavelength corresponding to a temperature using the arrangement shown in FIG. 2. This voltage waveform indicates the result of observing the temperature detection waveform of the printhead 1 of the inkjet printing apparatus at the input of an A/D converter (signal processing unit 12). This voltage waveform indicates an output Vo of the differential amplifier circuit 11. The differential amplifier circuit 11 is formed from a low-pass filter to amplify by about eight times an output from the temperature sensor 5 incorporated in the printhead 1 and remove high-frequency noise. As shown in FIG. 10, right and left flat sections correspond to periods during which the printhead 1 does not operate at sheet ends and a digital signal is idled. Voltage of right and left flat sections is 1.5 [V] on the basis of ground 17. In contrast, a center raised section corresponds to the period of a printing operation during which a digital signal operates. As shown in FIG. 10, digital signal noise N is combined with the first signal line 22 and second signal line 23, therefore, the voltage is increasing by 220 [mV] due to the digital signal noise N. The increase of the voltage is called an "offset voltage". For example, this 220 [mV] increase of voltage causes an approximately 13° C. temperature error. This combined noise voltage N has a vertically asymmetrical noise waveform due to nonlinearity of the temperature sensor 5. Even if the voltage wavelength is processed by a subsequent stage circuit, the offset voltage cannot be removed.

The embodiment can reduce such an offset voltage and greatly suppress the temperature detection error to about 1° C. even during the operation of a digital signal. An arrangement which reduces the detection error in the embodiment will now be explained.

Figure 3:
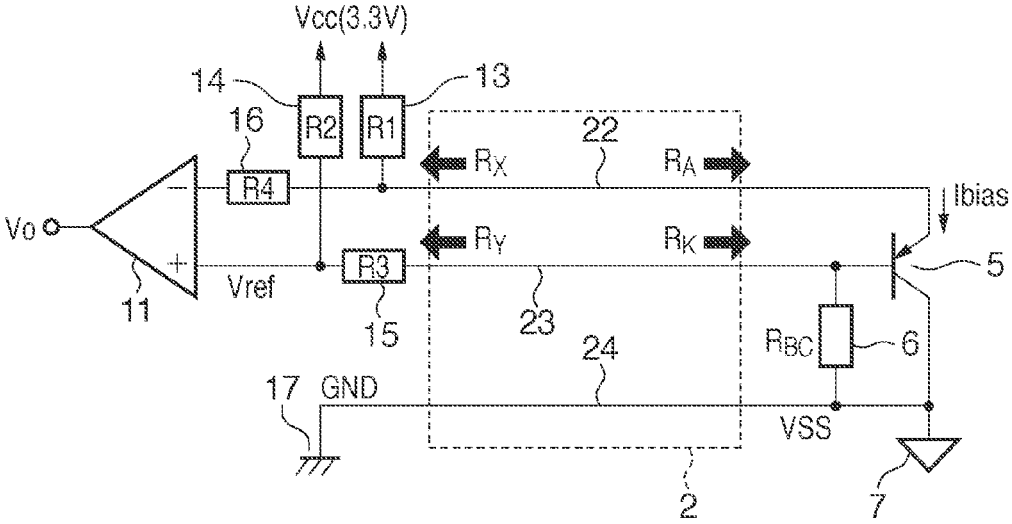
FIG. 3 is a circuit diagram showing the arrangement of a control unit 3 in FIG. 1A.
Figure 4:
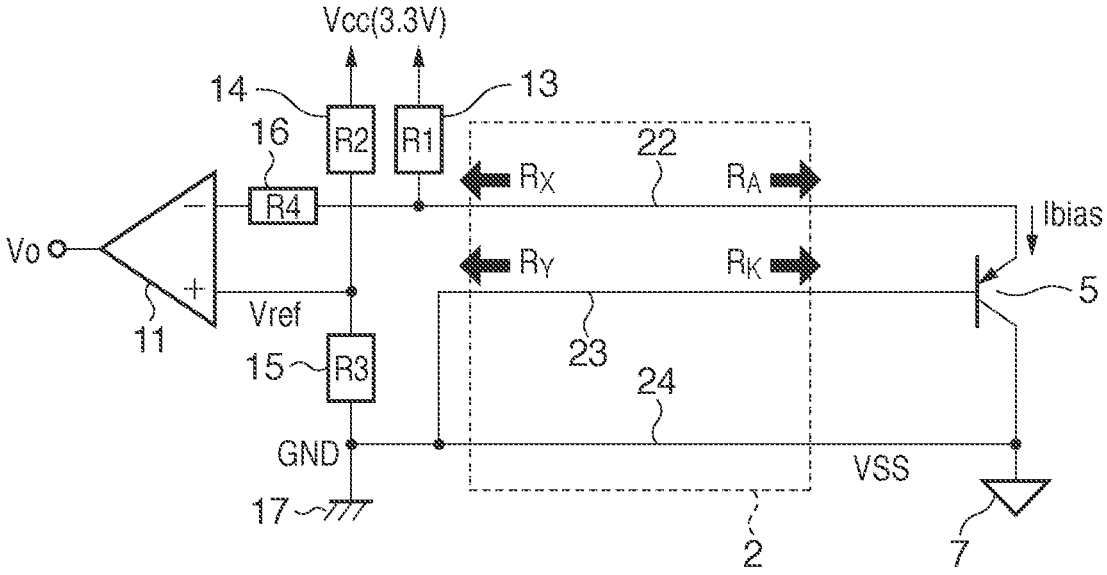
FIG. 4 is a circuit diagram showing the arrangement of a control unit 3 in FIG. 2.

FIGS. 3 and 4 are circuit diagrams showing the arrangements of the control units 3 in FIGS. 1A and 2, respectively. Attention is paid to the wiring resistances of the noise-combined first signal line 22 and second signal line 23. As shown in FIG. 3, $R_A$ is an input impedance of the first signal line 22 on the emitter terminal side of the temperature sensor 5, and $R_K$ is an input impedance of the second signal line 23 on the base terminal side of the temperature sensor 5. Also, $R_X$ is an input impedance of the first signal line 22 on the side of the differential amplifier circuit 11, and $R_Y$ is an input impedance of the second signal line 23 on the side of the differential amplifier circuit 11.

Figure 5A:
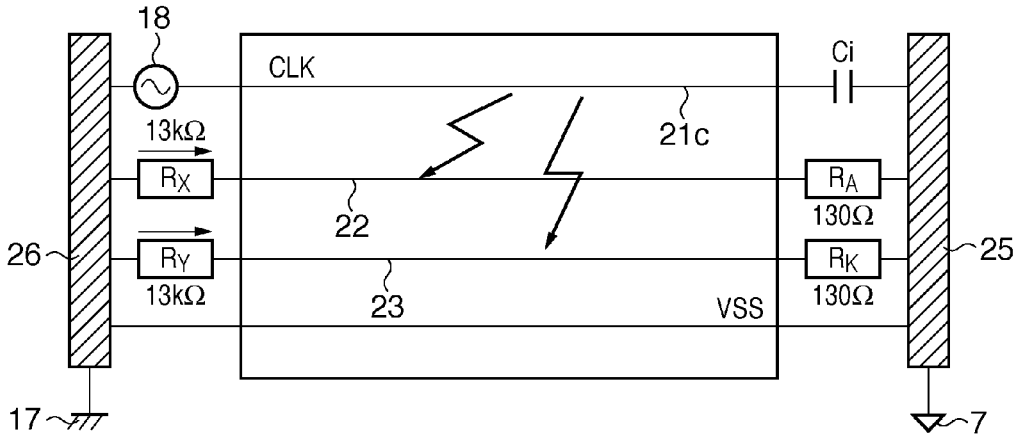
FIGS. 5A and 5B are views showing the transmission line models of FIGS. 3 and 4, respectively.
Figure 5B:
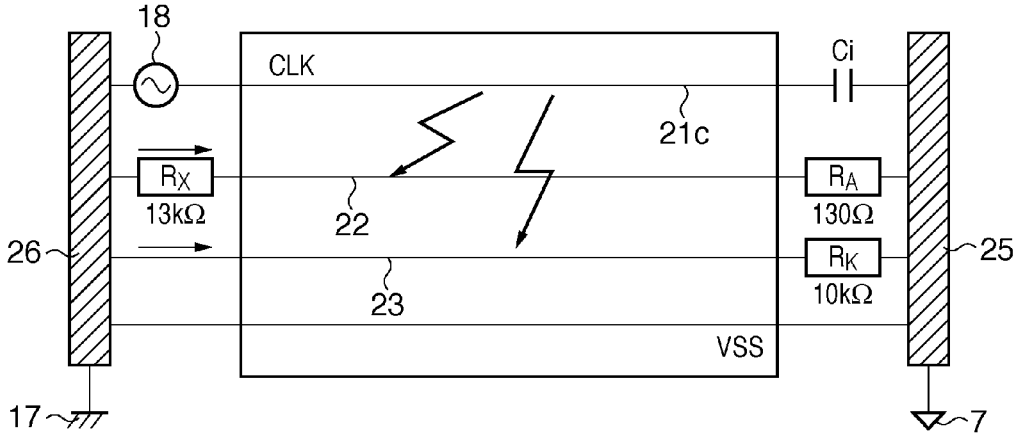

Details of the input impedance at each portion will be described later. FIGS. 5A and 5B show the transmission line models of FIGS. 3 and 4, respectively. A wiring line 21*c* is a line for clock signal. The wiring line 21*c* is connected to a noise signal source (clock generate unit) 18. $R_A$ is an input impedance of the first signal line 22 on the emitter terminal side of the temperature sensor 5 (FIG. 3), and $R_K$ is an input impedance of the second signal line 23 on the base terminal side of the temperature sensor 5 (FIG. 3). $R_X$ is an input impedance of the first signal line 22 on the side of the control units 3, and $R_Y$ is an input impedance of the second signal line 23 on the side of the printhead 1. In the following description, the noise signal source 18 is a clock signal CLK flowing through the wiring member 2. As shown in FIGS. 5A and 5B, an equivalent capacitor Ci is formed at the termination of the clock signal CLK on the side of the printhead 1.

An equivalent capacitor Ci is connected to the ground 25 which is regarded as AC ground for the printhead 1. An impedance $R_A$ and an impedance $R_K$ are also connected to the ground 25. On the other hand, the noise signal source 18 is connected to the ground 26 which is also regarded as AC ground for the printhead 1. An impedance $R_X$ and an impedance $R_Y$ are also connected to the ground 26.

The transmission line models of FIGS. 5A and 5B will now be examined. A combined noise voltage is determined by the coupled impedances of wiring line 21*c* which generates the noise (clock signal CLK) and noise-affected wiring lines (first signal line 22 and second signal line 23), and the load impedances across the noise-affected wiring lines. When the first signal line 22 and second signal line 23 are adjacent to each other, the coupled impedance with the wiring line 21*c* is equal between the first signal line 22 and the second signal line 23 (In short, the coupled impedance between the wiring line 21*c* and the first signal line 22 is equal (approximately equal) to the coupled impedance between the wiring line 21*c* and the second signal line 23). The noise voltage is thus regarded to arise from the difference between the load impedances across the first signal line 22 and second signal line 23 respectively.

In the model shown in FIG. 5A, the values of the input impedances $R_A$ and $R_K$ on the side of the temperature sensor 5 are equal to each other, and those of the input impedances $R_X$ and $R_Y$ on the side of the control unit 3 are equal to each other. As a result, a noise voltage combined with the first signal line 22 and that combined with the second signal line 23, which are generated on the side of the control unit 3, are balanced with each other. That is, noise voltages generated at the two input terminals of the differential amplifier circuit 11 in the control unit 3 act as in-phase noise components and are canceled. Therefore, a noise voltage generated in the output voltage VO of the differential amplifier circuit 11 is reduced. However, in the conventional model shown in FIG. 5B, the input impedance $R_Y$ on the side of the control unit 3 is 0. A noise voltage combined with the first signal line 22 and that combined with the second signal line 23, which are generated on the side of the control unit 3, are not balanced with each other. The output voltage VO of the differential amplifier circuit 11 is output with a combined noise voltage amplified directly.

As described above, to reduce combined noise, it is important to consider the following two points on the transmission line on which the first signal line 22 and second signal line 23 interfere with the noise source signal. First, the first signal line 22 and second signal line 23 are arranged adjacent to each other. Second, the input impedances across the first signal line 22 and second signal line 23 are equalized. However, even if the input impedances are not completely equal, in-phase noise components generated at the two input terminals of the differential amplifier circuit 11 are canceled, so the noise reduction effect can be expected. It suffices to determine the degree of impedance balance based on a permissible temperature detection error. Resistance values at the termination of the transmission line shown in FIG. 5A are determined based on the result of verification experiment using an equivalent circuit model to be described later.

FIG. 3 is a circuit diagram showing a circuit which implements the transmission line model shown in FIG. 5A. In the embodiment, a resistor $R_{BC}$ serving as a matching circuit is interposed between the base and collector of a pnp transistor which forms the temperature sensor 5. The resistor $R_{BC}$ interposed between the base and the collector has two purposes. One is to equalize (match) the input impedances $R_K$ and $R_A$. For this purpose, the resistor $R_{BC}$ is interposed between the base terminal and grounded collector terminal of the temperature sensor 5. The other is to set, as GND on the side of the printhead 1, the 0–V reference for setting the reference voltage Vref of the differential amplifier circuit 11. The resistor $R_{BC}$ is thus interposed between the base terminal and grounded collector terminal of the temperature sensor 5. The input impedance $R_Y$ can be set not to 0 as shown in FIG. 5B but to an arbitrary value depending on the values of the resistor 14 (R2) and resistor 15 (R3). The resistor $R_{BC}$ interposed between the base and collector of the pnp transistor may be a polysilicon resistor or diffused resistor formed inside the printhead 1 by a semiconductor manufacturing process. The resistor $R_{BC}$ may also be a resistance element mounted outside the printhead 1.

How to determine the four input impedances $R_A$, $R_K$, $R_X$, and $R_Y$ shown in FIG. 3 will now be described in detail with reference to FIG. 3.

The input impedance $R_X$ is the parallel resistance of the resistor 13 (R1) for supplying the DC bias current of the temperature sensor 5 and an input resistor 16 (R4) of the differential amplifier circuit 11. For R1<<R4, the input impedance $R_X$ is given by equation (2):

$$R_X \approx R1 \tag{2}$$

The input impedance $R_Y$ is the series resistance of the resistor 14 (R2) and resistor 15 (R3). The input impedance $R_Y$ is given by equation (3):

$$R_Y = R2 + R3 \tag{3}$$

The input impedance $R_A$ is given by equation (4):

$$R_A = re + (rbb + R_{BC} // R_Y)/hfe \tag{4}$$

where "$R_{BC}//R_Y$" is the parallel combined resistance of $R_{BC}$ and $R_Y$.

The input impedance $R_K$ is given by equation (5):

$$R_K = R_{BC} // \{rbb + (re + R_X)hfe\} \tag{5}$$

where re is the emitter resistance, rbb is the base spreading resistance, and hfe is the emitter ground current amplification factor. The emitter resistance re is the ratio of a thermal voltage Vt determined by the Boltzmann constant k, elementary charge amount q, and absolute temperature T, and the bias current Ibias of the diode temperature sensor. The emitter resistance re is given by equation (6):

$$re = Vt/I\text{bias} = (kT/q)/I\text{bias} \tag{6}$$

If the current amplification factor hfe is sufficiently large (for example, 100 or 200) and re<<$R_{BC}$/hfe, $R_A$ and $R_K$ can be approximated into $R_A \approx$re and $R_K \approx R_{BC}$.

In the arrangement shown in FIG. 3, resistance values are set as follows. First, the DC bias current Ibias flowing through the temperature sensor 5 is set to 0.2 mA. This is obtained by the resistor 13 (R1), as indicated by equation (7):

$$I\text{bias} = (Vcc - Vbe - Vbc)/R1 \tag{7}$$

The base-emitter voltage Vbe of the pnp transistor is about 0.65 V. The base-collector voltage Vbc, which is determined by the voltage division ratio of the resistor 6 ($R_{BC}$), resistor 14 (R2), and resistor 15 (R3), can be regarded as almost 0 V.

For Vcc=3.3 V, the resistor 13 (R1) is given by equation (8):

$$R1 = (3.3 - 0.65)/0.2\ [\text{mA}] \approx 13\ [\text{K}\Omega] \tag{8}$$

The input resistor 16 (R4) of the differential amplifier circuit 11 has a value large enough not to change the amplification factor under the influence of R1. In the embodiment, R4=100 [kΩ]. From this, the input impedance $R_X$ is $R_X \approx$R1=13 [KΩ] in accordance with equation (2).

The resistor 14 (R2) and resistor 15 (R3) which set the reference voltage Vref of the differential amplifier circuit 11 are obtained as follows. Since the input impedance $R_Y$ is set equal to the input impedance $R_X$, $R_Y$=R2+R3=13 [kΩ] in accordance with equation (3). The reference voltage Vref and voltage amplification factor of the differential amplifier circuit 11 are determined so that the fluctuation width of the output voltage VO falls within the input voltage range of the A/D converter of the signal processing unit 12 on the next stage. In the embodiment, the forward voltage of the temperature sensor 5, that is, the base-emitter voltage Vbe of the pnp transistor is set to 0.7 V (0° C.) to 0.5 V (100° C.) at a temperature characteristic of −2 mV/° C., a detected temperature range of 0° C. to 100° C., and a forward voltage of 0.65 V at 25° C. Assuming that the fluctuation in the manufacturing process is ±0.05 V, the Vbe fluctuation range is 0.45 V to 0.75 V. If the input voltage range of the A/D converter is set to 0.5 V to 2.75 V, the voltage amplification factor is 7.5. For the Vbe fluctuation range of 0.45 V to 0.75 V, the reference voltage Vref is determined so that a 7.5 times-amplified voltage falls within the A/D converter input voltage range of 0.5 V to 2.75 V. Then, Vref=0.72 V. From R2+R3=13 [kΩ], R2=10 [kΩ] and R3=2.7 [kΩ] are obtained based on the voltage division ratio.

Finally, setting of the resistance value of the resistor $R_{BC}$ interposed between the base and collector of the temperature sensor 5 will now be explained. As described above, when the current amplification factor hfe of the pnp transistor is sufficiently large and re<<$R_{BC}$/hfe, $R_A$ and $R_K$ can be approximated into $R_A \approx$re and $R_K \approx R_{BC}$. To make the input impedances $R_A$ and $R_K$ match each other, $R_{BC}$=re suffices. From equation (6), the emitter resistance re is re≈25.8 [mV]/0.2 [mA]=130[Ω]. Thus, $R_{BC}$=130[Ω] suffices. The termination resistance values shown in FIG. 5A are an example at the above settings.

It has been explained that equations (4) and (5) can approximate $R_A \approx$re and $R_K \approx R_{BC}$ for a sufficiently large current amplification factor hfe. A case in which the current amplification factor hfe is small (for example, 5 or 10) will now be described.

The result of experiment reveals that frequencies at which actually combined noise generates a problem are 100 MHz to 150 MHz. At these frequencies, the current amplification factor hfe of the transistor greatly decreases, failing to establish the above-described approximation equations.

Considering this, the input impedances $R_A$ and $R_K$ are calculated at different $R_{BC}$ values using equation (4) for the input impedance $R_A$ and equation (5) for the input impedance $R_K$. FIG. 17 shows the calculation result. The calculation conditions are the bias current Ibias of the temperature sensor 5=0.2 [mA], the base spreading resistance rbb of the pnp transistor=50[Ω], the input impedance $R_X$=13 [kΩ], and the emitter resistance re=130[Ω].

As shown in FIG. 17, when the current amplification factor hfe of the transistor is 1, that is, no current amplification effect acts, the ratio of the values of the input impedances $R_A$ and $R_K$ falls within the range of about 5 times as long as the $R_{BC}$ value is 50[Ω] or larger. It can be estimated from FIG. 17 that the base-collector resistance resistor $R_{BC}$ is effective for noise reduction if it is not equal to the emitter resistance but is a certain value or larger.

Figure 6:
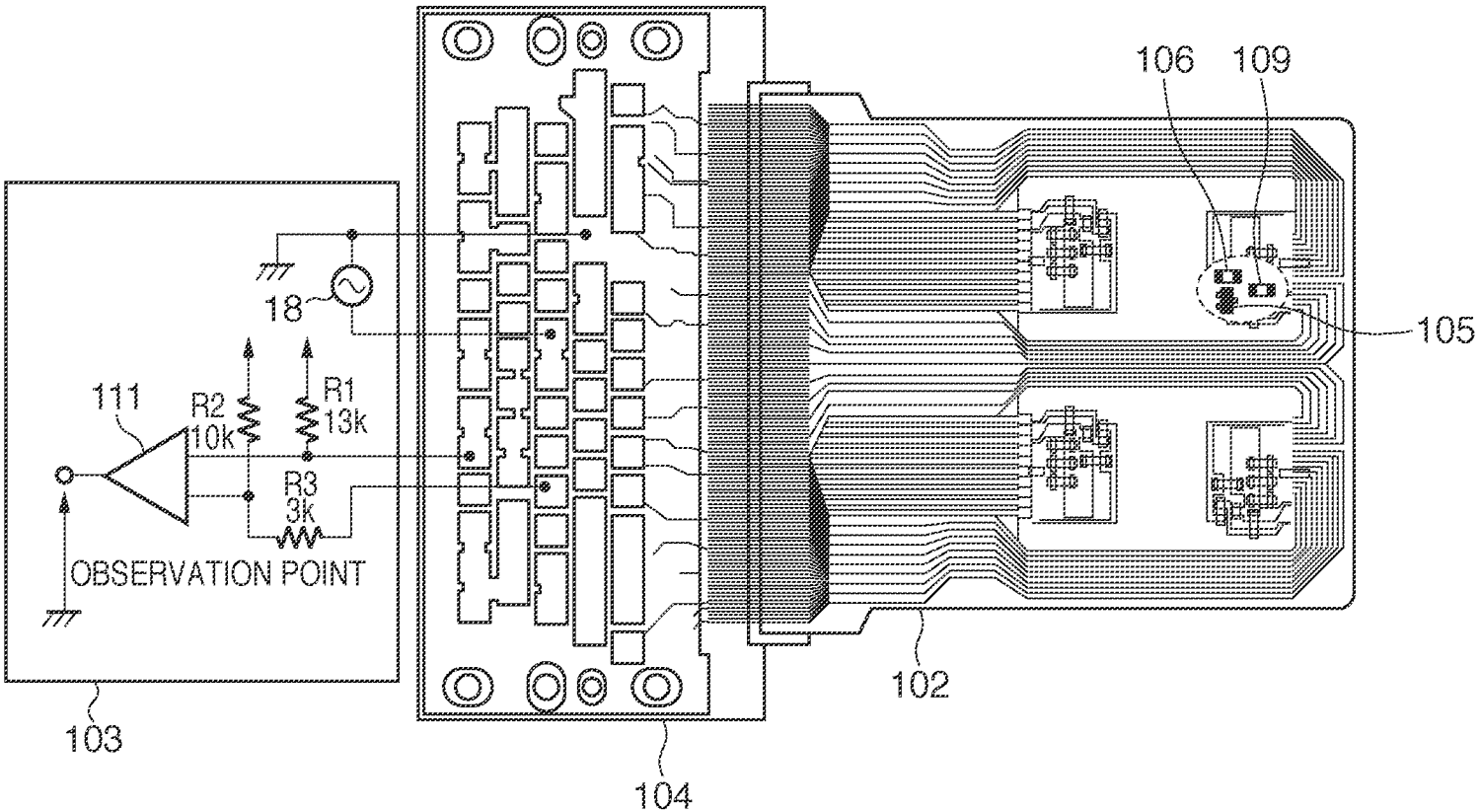
FIG. 6 is a circuit diagram showing a circuit model used for verification experiment.
Figure 7:
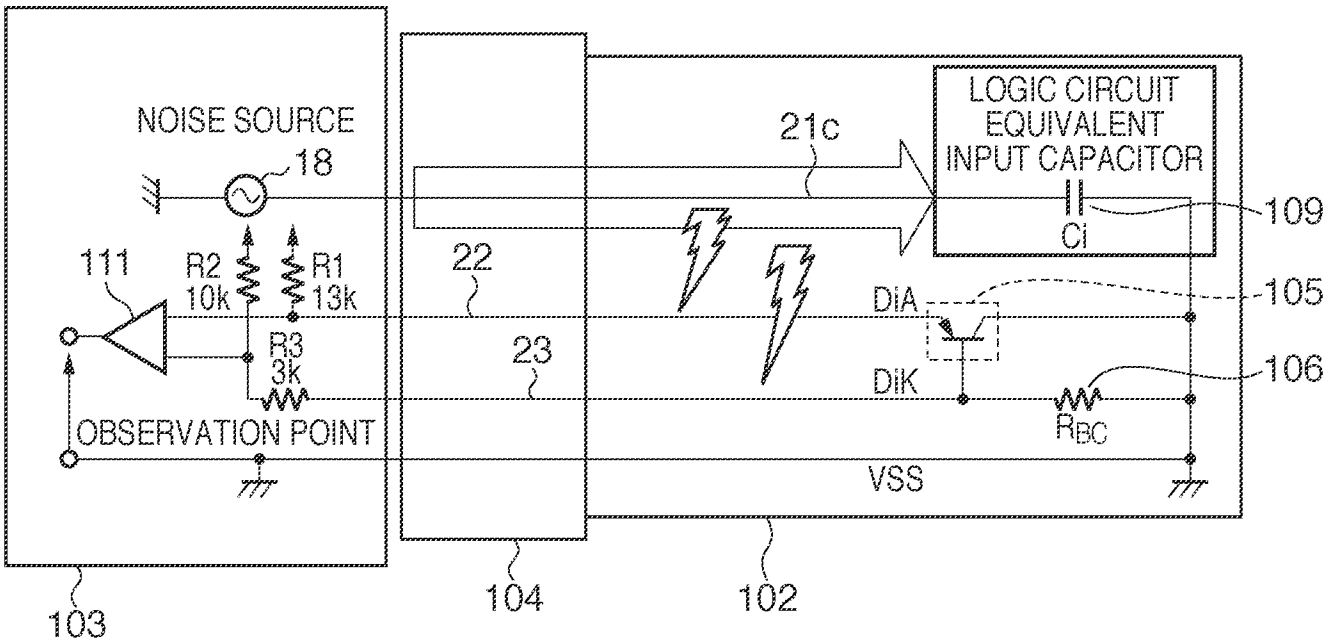
FIG. 7 is a circuit diagram showing the equivalent circuit of the circuit model in FIG. 6.
Figure 8:
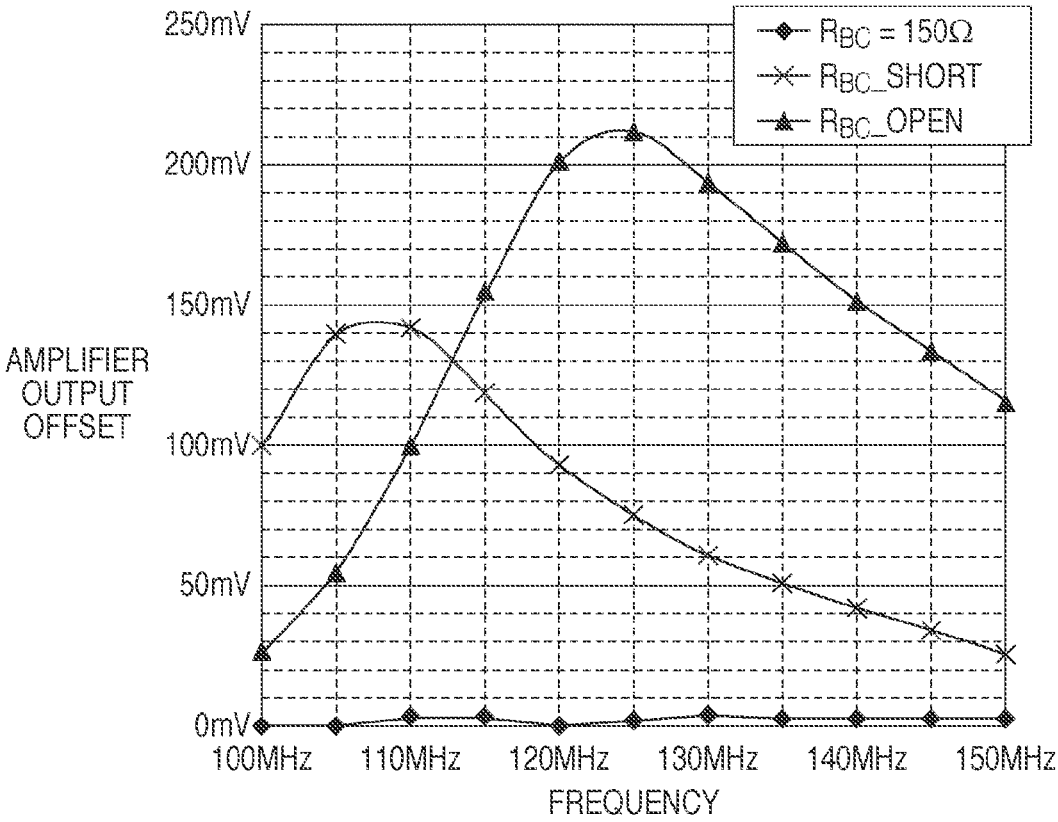
FIG. 8 is a graph showing the result of measuring an offset voltage generated in an output voltage when the sine wave of the noise source was changed.

To confirm this, experimental verification was performed using the following equivalent circuit model. FIG. 6 shows a circuit model used for experimental verification, and FIG. 7 shows the equivalent circuit of the circuit model in FIG. 6. In the equivalent circuit shown in FIG. 7, an FPC 102 configured to attach the printhead of an inkjet printing apparatus, and a printed board 104 having a connection pad for the inkjet printing apparatus main body operate as a noise propagation path, and the output voltage of a differential amplifier circuit 111 of a control unit 103 is measured. In this model, a pnp transistor 105, a resistance element 106, and a capacitor 109 having a capacitance value of 10 pF as a digital signal termination capacitance are mounted on the FPC 102 instead of the printhead. Further, a sine wave with an amplitude of 250 mVpp is input as signal of a noise source 18. Under these conditions, an offset voltage generated in the output voltage VO of the differential amplifier circuit 111 was measured. FIG. 8 shows an offset voltage generated in the output voltage VO when the sine wave of the noise source 18 was changed within the range of 100 MHz to 150 MHz.

As shown in FIG. 8, it can be confirmed that the offset voltage greatly changes between different base-collector resistances $R_{BC}$. As shown in FIG. 8, the offset voltage increases in the conventional arrangement as shown in FIGS. 2 and 4 (for "$R_{BC}$_open" shown in FIG. 8). In this case, input impedances across the transmission line differ between the first signal line 22 and the second signal line 23. It can be confirmed that the influence of combined noise is serious. For "$R_{BC}$_short", the circuit arrangement is the same as that in FIGS. 1A and 3 except that the base and collector are series-connected. In this case, only $R_X$ and $R_Y$ are equal out of the input impedances of the transmission line, and the input impedances $R_A$ and $R_K$ on the side of the temperature sensor 5 are different because of the input impedance $R_K$=0[Ω]. However, for $R_{BC}$=150[Ω], the offset of the output voltage VO becomes ideally almost 0. That is, it was confirmed that combined noise can be reduced to almost 0 when input impedances across the transmission line become equal between the first signal line 22 and the second signal line 23.

Figure 9A:
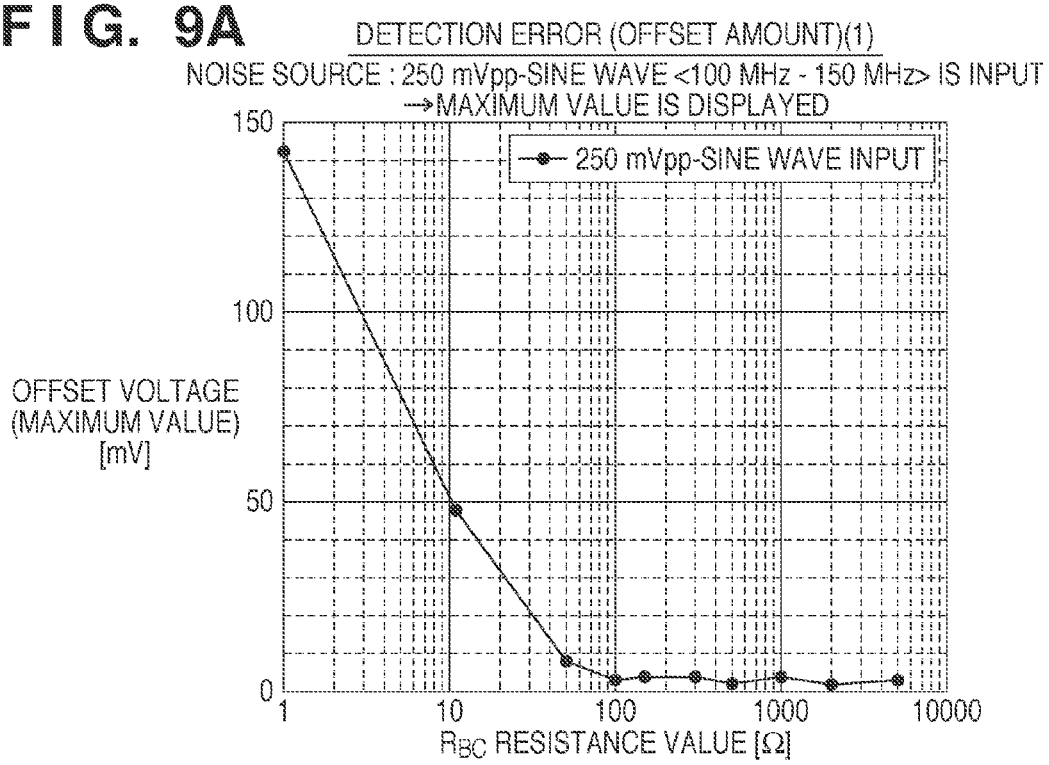
FIGS. 9A and 9B are graphs each showing the result of measurement when a sine wave with an amplitude of 250 mVpp was input as a noise source.
Figure 9B:
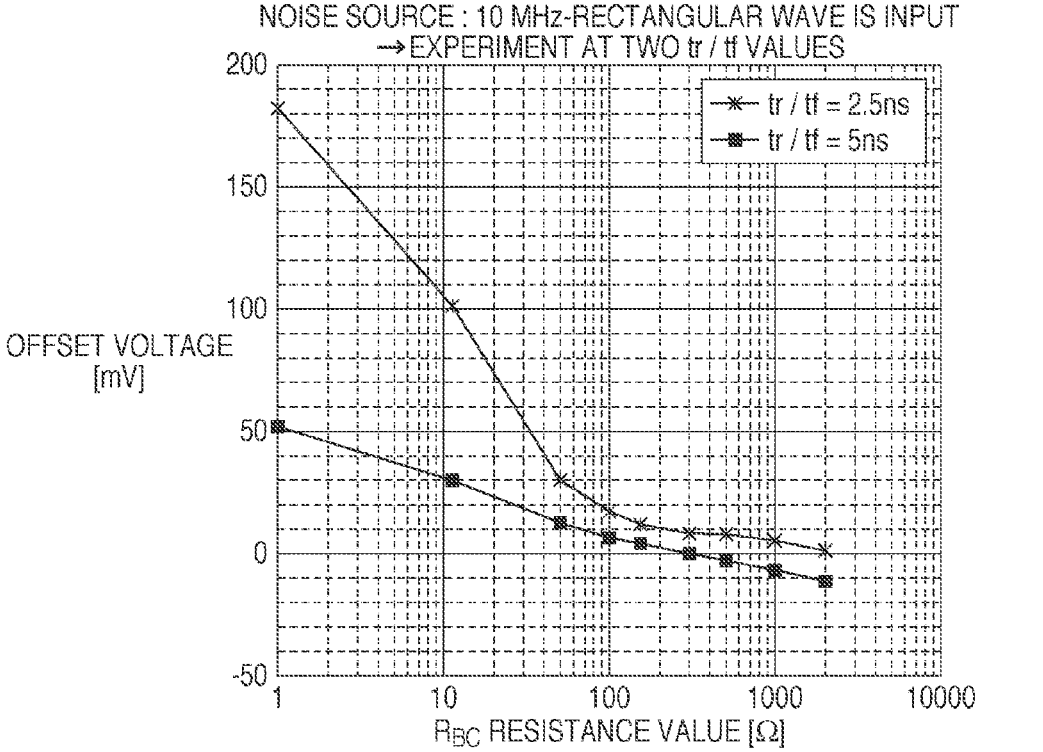

Then, the offset voltage of the output voltage VO was measured while changing the base-collector resistor $R_{BC}$ from 0[Ω] to 5 [kΩ] using the same circuit model of FIG. 6. FIG. 9A shows the measurement result when a sine wave (100 MHz to 150 MHz) with an amplitude of 250 mVpp was input as a noise source 18. In FIG. 9A, values at frequencies at which the offset voltage maximizes within the frequency range of 100 MHz to 150 MHz are plotted along the ordinate. FIG. 9B shows the result when rectangular waves (two rise/fall times of 2.5 ns and 5 ns) with an amplitude of 3.3 V and a frequency of 10 MHz were input as noise sources. It can be confirmed that the offset voltage of the output voltage VO greatly decreases at a base-collector resistance $R_{BC}$ of 50[Ω] or larger for either noise source.

From the above verification experiment results, an offset voltage generated by combined noise can be reduced to almost 0 by setting the resistor $R_{BC}$ interposed between the base and the collector to have a value larger than ⅓ of the emitter resistance re determined by the bias current Ibias.

In the embodiment, the lower limit value of the resistor $R_{BC}$ at which the noise reduction effect acts is set larger than ⅓ of the value of the emitter resistance re. However, the lower limit value may be arbitrarily determined in accordance with a detected temperature tolerance requested of the inkjet printing apparatus equipped with the control unit 3. For example, if an offset voltage of 40 [mV] corresponding to $R_{BC}$=13[Ω] shown in FIG. 9A is permitted, the $R_{BC}$ value may be set to 13[Ω] which is 1/10 of the emitter resistance re.

Figure 1B:
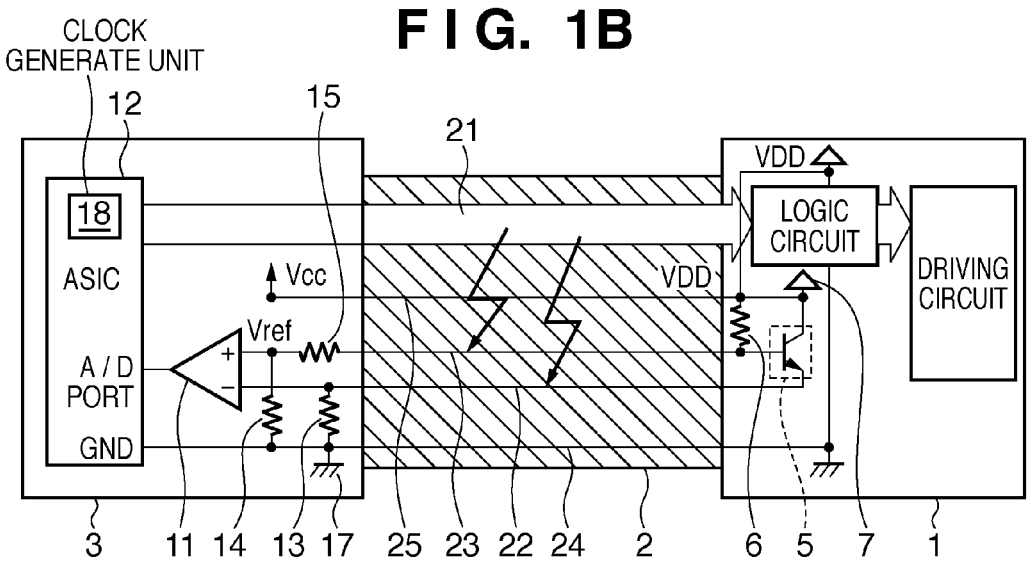
Figure 12A:
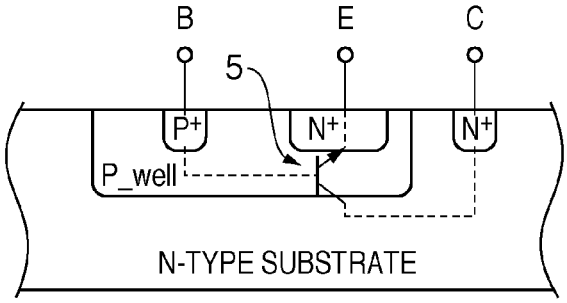
FIGS. 12A, 12B, and 12C are sectional views each exemplifying the structure of the temperature sensor.
Figure 12B:
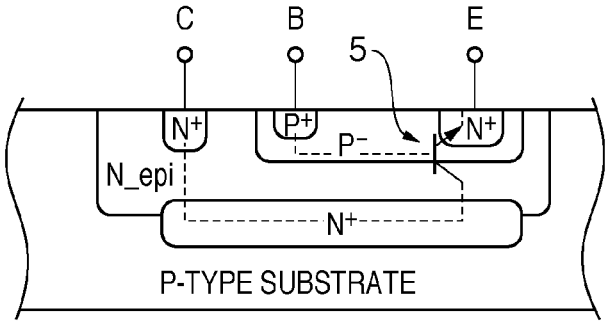
Figure 12C:
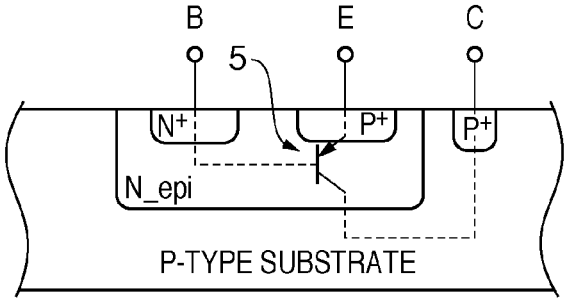
Figure 13A:
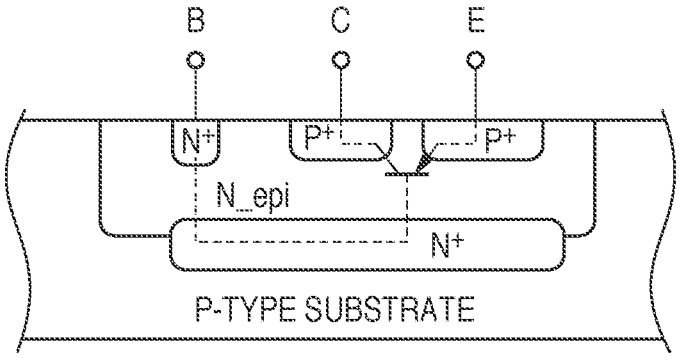
FIGS. 13A and 13B are sectional views each exemplifying another structure of the temperature sensor.
Figure 13B:
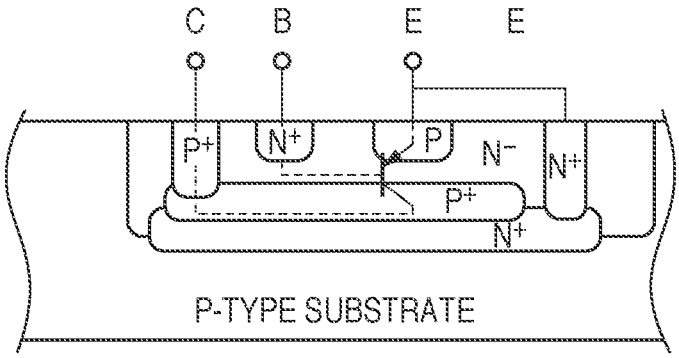
Figure 14:
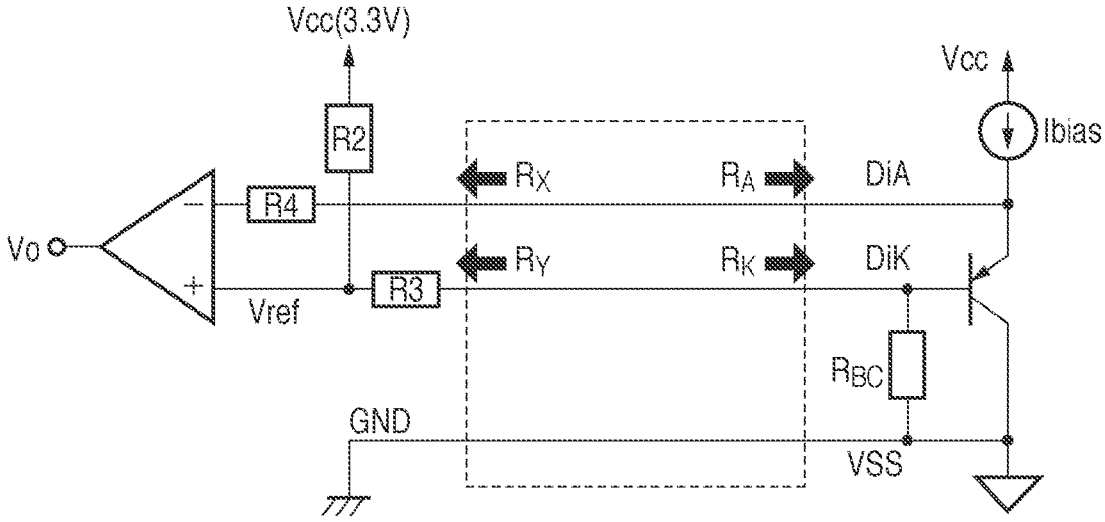
FIG. 14 is a circuit diagram showing a case in which the bias current source is a constant current source circuit formed in a printhead.

The temperature sensor 5 and control unit 3 described above are applicable to even another arrangement to be described below. The bias current source for supplying a forward bias current to the p-n junction of the temperature sensor 5 may be a constant current source circuit formed in the printhead 1, as shown in FIG. 14. The temperature sensor 5 may be formed from an npn transistor. The simplest structure for forming a forward biased p-n junction in a CMOS semiconductor process using an n-type semiconductor substrate is a substrate npn transistor shown in FIG. 12A. FIG. 1B shows an arrangement in which the base-emitter junction of the substrate npn transistor is used as the temperature sensor 5. The first signal line 22 is connected to the emitter terminal of the transistor 5. The first signal line 22 is also connected to the ground pattern 17 of the control unit 3 via the resistor 13.

And, the second signal line 23 is connected to the ground pattern 17 via the resistor 14 so that the reference voltage of the reference voltage terminal of the differential amplifier circuit 11 is determined. The second signal line 23 is also connected to VDD via the resistor 15 and the resistor 6 of the printhead 1.

The resistor 13 for supplying a forward bias current to the temperature sensor 5 is interposed between the second signal line 23 connected to the emitter terminal and the GND wiring line 24. The resistor 6 for equalizing the input impedances across the first signal line 22 and second signal line 23 is interposed between the base terminal connected to the first signal line 22 and the collector terminal connected to the power supply voltage VDD.

Other arrangements of the temperature sensor 5 formed in the printhead 1 to which the embodiment is applicable will be exemplified. Transistor structures shown in FIGS. 12B, 12C, 13A, and 13B are arrangement examples of transistors each formed by a bipolar process using a p-type semiconductor substrate. The temperature sensor can be configured by supplying a forward bias current to the p-n junction of each illustrated transistor. Although arrangement examples of the control unit 3 for these examples will not be shown, a control unit 3 identical to those in FIGS. 1A and 1B is configured.

The transistor may also be used as the temperature sensor 5 by applying a forward bias to the p-n junction between the base and collector of the transistor. In this case, the resistor is interposed between the base and the emitter. This means that the transistor is used as the temperature sensor 5 by replacing its collector and emitter with each other.

The above embodiment has described an example in which only one temperature sensor 5 is mounted in the printhead 1, but a plurality of temperature sensors 5 may be arranged in the printhead 1. Also, a switch may be arranged at the input of the control unit 3 to switch between signal lines running from a plurality of temperature sensors 5 and connect one of them to the control unit 3.

When a plurality of temperature sensors 5 are arranged in the printhead 1, one second signal line 23 running from the base terminal may be shared between the temperature sensors 5 each formed from a pnp transistor in order to save the contact pads and signal lines of the printhead 1. In this case, only the first signal lines 22 may be extracted as separate wiring lines from the temperature sensors 5. The resistor inserted to equalize the input impedances across the first signal line 22 and second signal line 23 is interposed between the shared second signal line 23 and the substrate. Resistance values suffice to be those described in the above embodiment.

In the arrangements exemplified in FIGS. 1A and 1B, the control unit 3 including the differential amplifier circuit 11 is arranged outside the printhead 1, and the wiring member such as an FPC connects the temperature sensor 5 and control unit 3. However, the printhead 1 may incorporate the control unit 3 including the differential amplifier circuit 11. In this case, the wiring line between the temperature sensor 5 and the differential amplifier circuit 11 in the printhead 1 is regarded as a transmission line. The resistor 6 arranged to equalize the input impedances across the first signal line 22 and second signal line 23 is interposed between the base and collector of the transistor which forms the temperature sensor 5.

Figure 15:
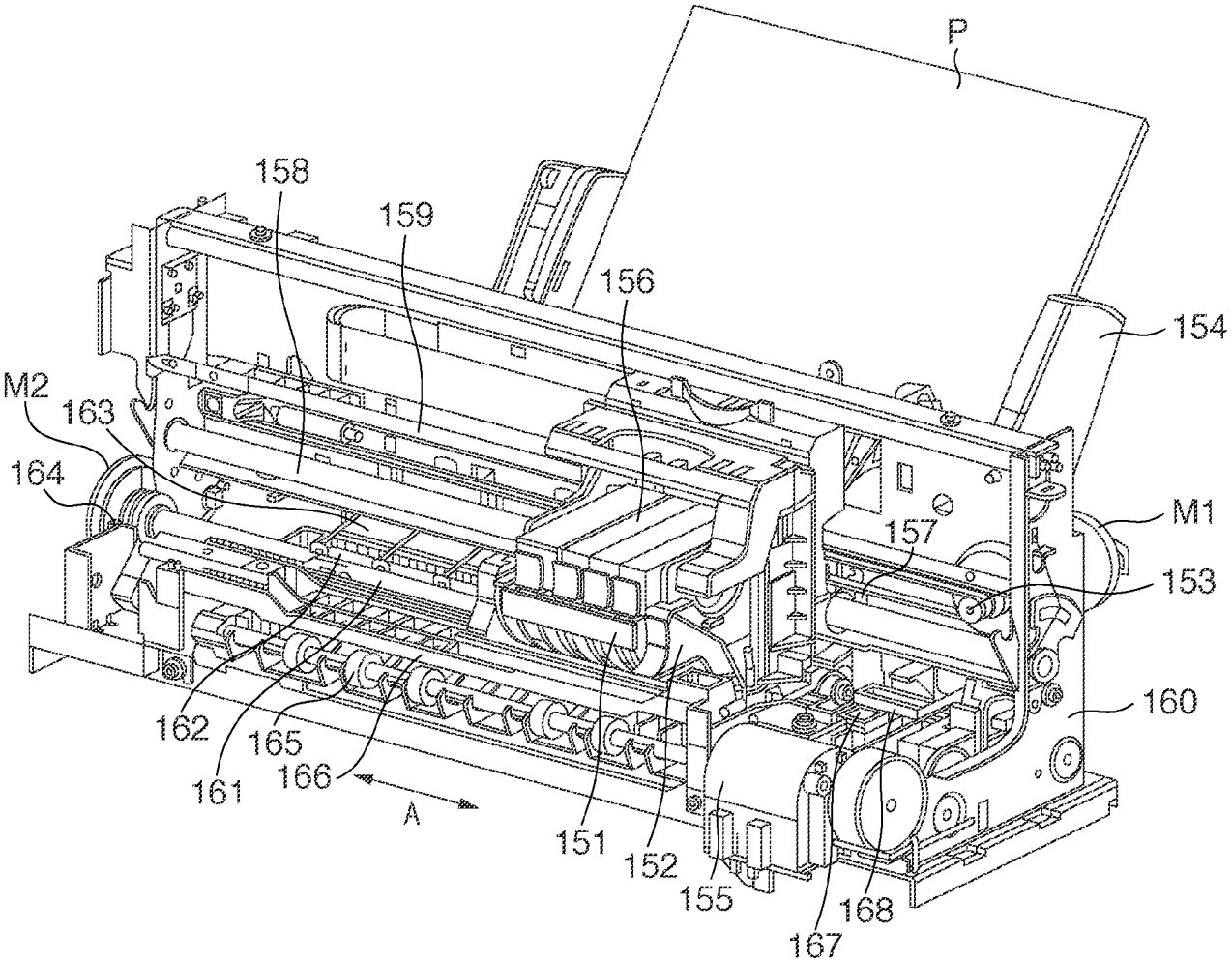
FIG. 15 is a perspective view showing an inkjet printing apparatus including the printhead and control unit shown in FIG. 1A.

FIG. 15 is a perspective view showing an inkjet printing apparatus including the printhead 1 and control unit 3 shown in FIG. 1A.

As shown in FIG. 15, the inkjet printing apparatus (to be referred to as a printing apparatus) prints in the following way. A transmission mechanism 153 transmits a driving force generated by a carriage motor M1 to a carriage 152 which supports a printhead 151 configured to print by discharging ink according to an inkjet method. The carriage 152 then reciprocates in directions indicated by an arrow A. A printing medium P such as a printing sheet is fed via a paper feed mechanism 154 and conveyed to a printing position. At the printing position, the printhead 151 discharges ink to the printing medium P, thereby printing.

To maintain a good state of the printhead 151, the carriage 152 moves to the position of a recovery device 155 to intermittently perform discharge recovery processing of the printhead 151.

The carriage 152 of the printing apparatus supports the printhead 151 and in addition, an ink cartridge 156 which stores ink to be supplied to the printhead 151. The ink cartridge 156 is freely detachable from the carriage 152.

The printing apparatus shown in FIG. 15 can print in color. For this purpose, four ink cartridges are mounted on the carriage 152 and store magenta (M), cyan (C), yellow (Y), and black (K) inks, respectively. These four ink cartridges are independently detachable.

The carriage 152 and printhead 151 can achieve and maintain a necessary electrical connection by bringing their junction surfaces into contact with each other appropriately. By applying energy in accordance with a printing signal, the printhead 151 selectively discharges ink from a plurality of orifices to print. Particularly, the printhead 151 of the embodiment adopts an inkjet method of discharging ink using thermal energy, and includes an electrothermal transducer for generating thermal energy. Electrical energy applied to the electrothermal transducer is converted into thermal energy, which is applied to ink, generating film boiling. Resultant growth and shrinkage of bubbles change the pressure. By utilizing the pressure change, ink is discharged from the orifice. The electrothermal transducer is arranged in correspondence with each orifice. A pulse voltage is applied to an electrothermal transducer corresponding to a printing signal, discharging ink from a corresponding orifice.

As shown in FIG. 15, the carriage 152 is coupled to part of a driving belt 157 of the transmission mechanism 153 which transmits the driving force of the carriage motor M1. The carriage 152 is slidably guided and supported along a guide shaft 158 in the directions indicated by the arrow A. The carriage 152 therefore reciprocates along the guide shaft 158 in response to forward rotation and backward rotation of the carriage motor M1. A scale 159 is arranged in the moving direction (directions indicated by the arrow A) of the carriage 152 to indicate the absolute position of the carriage 152. In the embodiment, the scale 159 is formed by printing black bars at necessary pitches on a transparent PET film. One end of the scale 159 is fixed to a chassis 160, and the other is supported by a leaf spring (not shown).

The printing apparatus includes a platen (not shown) which faces an orifice surface having the orifices (not shown) of the printhead 151. Simultaneously when the carriage 152 with the printhead 151 reciprocates by the driving force of the carriage motor M1, a printing signal is supplied to the printhead 151 to discharge ink, thereby printing at the full width of the printing medium P conveyed on the platen.

The printing apparatus further includes a conveyance roller 161 which is driven by a conveyance motor M2 to convey the printing medium P, a pinch roller 162 which brings the printing medium P into contact with the conveyance roller 161 via a spring (not shown), a pinch roller holder 163 which rotatably supports the pinch roller 162, and a conveyance roller gear 164 which is fixed at one end of the conveyance roller 161. The conveyance roller 161 is driven by rotation of the conveyance motor M2 that is transmitted to the conveyance roller gear 164 via an intermediate gear (not shown).

The printing apparatus also includes a discharge roller 165 for discharging the printing medium P bearing an image formed by the printhead 151 outside the printing apparatus. The discharge roller 165 is driven by transmitting rotation of the conveyance motor M2. Note that the discharge roller 165 brings the printing medium P into contact with a spur roller (not shown) in press contact by a spring (not shown). A spur holder 166 rotatably supports the spur roller.

As shown in FIG. 15, the printing apparatus includes the recovery device 155 at a desired position (for example, a position corresponding to the home position) outside the range of reciprocal motion (outside the printing region) for the printing operation of the carriage 152 having the printhead 151. The recovery device 155 recovers the printhead 151 from a discharge error.

The recovery device 155 includes a capping mechanism 167 which caps the orifice surface of the printhead 151, and a wiping mechanism 168 which cleans the orifice surface of the printhead 151. A suction unit (for example, suction pump) in the recovery device forcibly discharges ink from the orifices in synchronism with capping of the orifice surface by the capping mechanism 167. Accordingly, discharge recovery processing is done to, for example, remove viscous ink, bubbles, and the like from the ink channels of the printhead 151.

In a non-printing operation or the like, the capping mechanism 167 caps the orifice surface of the printhead 151 to protect the printhead 151 and prevent evaporation and drying of ink. The wiping mechanism 168 is arranged near the capping mechanism 167 to wipe ink droplets attached to the orifice surface of the printhead 151.

The capping mechanism 167 and wiping mechanism 168 can maintain a normal ink discharge state of the printhead 151.

Figure 16:
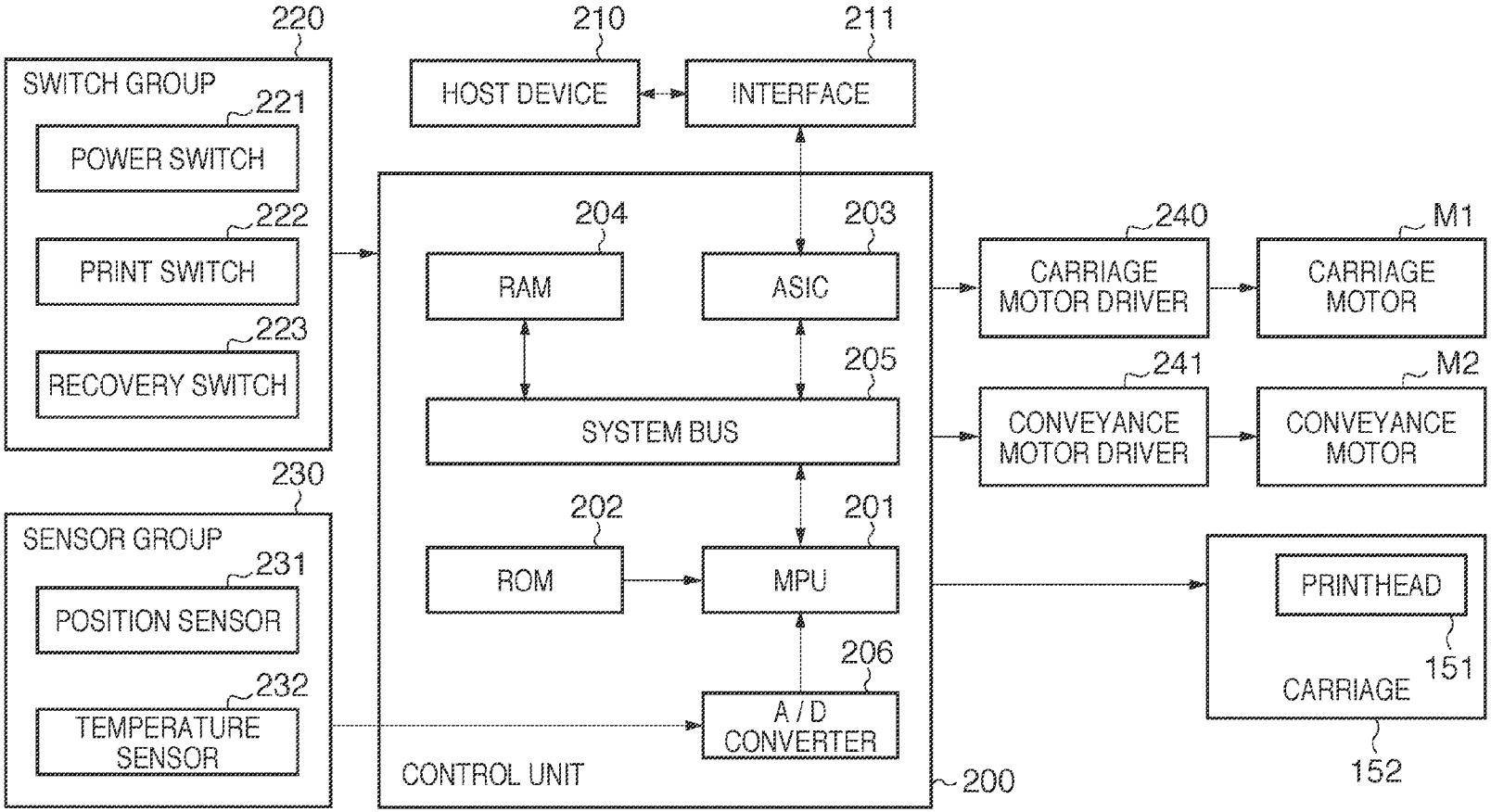
FIG. 16 is a block diagram showing the control arrangement of the printing apparatus shown in FIG. 15.

FIG. 16 is a block diagram showing the control arrangement of the printing apparatus shown in FIG. 15.

As shown in FIG. 16, a control unit 200 corresponding to the control unit 3 in FIG. 1A includes an MPU 201, ROM 202, application specific integrated circuit (ASIC) 203, RAM 204, system bus 205, and A/D converter 206. The ROM 202 stores programs corresponding to control sequences to be described later, necessary tables, and other permanent data. The ASIC 203 generates control signals to control the carriage motor M1, conveyance motor M2, and printhead 151. The RAM 204 provides an image data rasterization area and a work area for program execution. The system bus 205 connects the MPU 201, ASIC 203, and RAM 204 to each other to exchange data.

The A/D converter 206 receives an analog signal from a sensor group to be explained below, A/D-converts it, and supplies the digital signal to the MPU 201.

Referring to FIG. 16, a computer 210 (for example, a reader for image reading or a digital camera) serves as an image data supply source, and is generally called a host device. The host device 210 transmits/receives image data, commands, status signals, and the like to/from the printing apparatus via an interface (I/F) 211.

A switch group 220 includes switches to receive instructions input by the operator, such as a power switch 221, a print switch 222 to instruct the start of printing, and a recovery switch 223 to instruct activation of processing (recovery processing) for maintaining good ink discharge performance of the printhead 151. A sensor group 230 includes a position sensor 231 such as a photocoupler to detect a home position h, and a temperature sensor 232 provided at an appropriate position of the printing apparatus to detect the ambient temperature.

A carriage motor driver 240 drives the carriage motor M1 to reciprocally scan the carriage 152 in the directions indicated by the arrow A. A conveyance motor driver 241 drives the conveyance motor M2 to convey the printing medium P.

At the time of print scanning of the printhead 151, the ASIC 203 transfers printing element (discharge heater) driving data DATA to the printhead 151 while directly accessing the storage area of the ROM 202.

Note that the ink cartridge 156 and printhead 151 are separable in the arrangement shown in FIG. 15, but may be integrated to configure an interchangeable head cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-155251, filed Jul. 7, 2010, which is hereby incorporated by reference herein in its entirety.

What is claimed is:

1. An apparatus including a control unit which controls a device including a sensor, and a cable which connects the device and the control unit, comprising:

a first signal line and a second signal line configured to be respectively laid out on the cable and to be respectfully connected to the sensor, wherein a voltage occurred between the first signal line and the second signal line corresponds to a state of the device;

a differential amplifier circuit configured to be included in the control unit, amplify the voltage occurred between the first signal line and the second signal line, and output the amplified voltage as state information of the device; and an adjusting circuit configured to adjust a wiring resistance of the first signal line and a wiring resistance of the second signal line by grounding one of the first signal line and the second signal line via a resistor, wherein the sensor is a pnp transistor, the first signal line connects an emitter terminal of the pnp transistor and an input terminal of the differential amplifier circuit, the second signal line connects a base terminal of the pnp transistor and another input terminal of the differential amplifier circuit, and the resistor is connected between a grounded collector terminal of the pnp transistor and the base terminal.

2. The apparatus according to claim 1, wherein the adjusting circuit adjusts the wiring resistance of the first signal line and the wiring resistance of the second signal line to equalize the wiring resistance of the first signal line and the wiring resistance of the second signal line with each other.

3. The apparatus according to claim 1, wherein the sensor is a temperature sensor, and the state information is temperature information.

4. The apparatus according to claim 1, wherein the device is a printhead, and the apparatus is a printing apparatus.

5. The apparatus according to claim 4, wherein the printing apparatus is an inkjet printing apparatus.

6. An apparatus including a control unit which controls a device including a sensor, and a cable which connects the device and the control unit, comprising:

a first signal line and a second signal line configured to be respectively laid out on the cable and to be connected to the sensor, wherein a voltage occurred between the first signal line and the second signal line corresponds to a state of the device;

a differential amplifier circuit configured to be included in the control unit, amplify the voltage occurred between the first signal line and the second signal line, and output the amplified voltage as state information of the device; and an adjusting circuit configured to adjust a wiring resistance of the first signal line and a wiring resistance of the second signal line by connecting one of the first signal line and the second signal line via a resistor to a power supply line of the device, wherein the sensor is a npn transistor, the first signal line connects an emitter terminal of the npn transistor and an input terminal of the differential amplifier circuit, the second signal line connects a base terminal of the npn transistor and another input terminal of the differential amplifier circuit, and the resistor is connected between a collector terminal of the npn transistor and the base terminal, wherein the collector terminal is connected to the power supply line of the device.

7. The apparatus according to claim 6, wherein the collector terminal is connected to a high potential side of the power supply line of the device.

8. The apparatus according to claim 6, wherein the adjusting circuit adjusts the wiring resistance of the first signal line and the wiring resistance of the second signal line to equalize the wiring resistance of the first signal line and the wiring resistance of the second signal line with each other.

9. The apparatus according to claim 6, wherein the sensor is a temperature sensor, and the state information is temperature information.

10. The apparatus according to claim 6, wherein the device is a printhead, and the apparatus is a printing apparatus.

11. The apparatus according to claim 10, wherein the printing apparatus is an inkjet printing apparatus.

* * * * *